US006662535B2

(12) United States Patent
Pin

(10) Patent No.: US 6,662,535 B2
(45) Date of Patent: Dec. 16, 2003

(54) APPARATUS FOR BAGGING MATERIAL

(75) Inventor: Gérard Pin, Bellefeuille (CA)

(73) Assignee: 9004-2532 Québec Inc., Chambord (CA)

( * ) Notice: Subject to any disclaimer, the term of this patent is extended or adjusted under 35 U.S.C. 154(b) by 0 days.

(21) Appl. No.: 10/097,981

(22) Filed: Mar. 15, 2002

(65) Prior Publication Data

US 2002/0139089 A1 Oct. 3, 2002

Related U.S. Application Data

(60) Provisional application No. 60/305,162, filed on Jul. 16, 2001.

(30) Foreign Application Priority Data

Mar. 15, 2001 (CA) ..... 2340838

(51) Int. Cl.[7] ..... B65B 53/00

(52) U.S. Cl. ..... 53/556; 53/218; 53/261; 53/384.1; 53/389.1

(58) Field of Search ..... 53/409, 441, 459, 53/556, 384.1, 389.1, 386.1, 393, 204, 218, 261

(56) References Cited

U.S. PATENT DOCUMENTS

| | | | | | |
|---|---|---|---|---|---|
| 2,939,259 | A | * | 6/1960 | Heckler | 53/459 |
| 3,621,638 | A | * | 11/1971 | Grocke | 53/386.1 |
| 3,778,960 | A | * | 12/1973 | Christensen et al. | 53/386.1 |
| 3,902,303 | A | * | 9/1975 | King | 53/384.1 |
| 3,961,459 | A | * | 6/1976 | Wolske | 53/386.1 |
| 4,457,195 | A | * | 7/1984 | Brooks | 83/69 |
| 4,582,271 | A | * | 4/1986 | Takahashi | 242/420.6 |
| 4,895,314 | A | * | 1/1990 | Thievessen | 242/559.1 |
| 5,884,857 | A | * | 3/1999 | Martin-Cocher et al. | 242/160.4 |
| 6,032,439 | A | * | 3/2000 | Birkenfeld et al. | 53/459 |
| 6,381,929 | B1 | * | 5/2002 | Chen | 53/556 |

* cited by examiner

*Primary Examiner*—John Sipos
*Assistant Examiner*—Louis Huynh
(74) *Attorney, Agent, or Firm*—Ogilvy Renault; Kevin Murphy

(57) ABSTRACT

An apparatus and a method for individually bagging bundles into stretchable open bags. The apparatus comprises a bag stretching structure about which a bag can be turned inside out for wrapping an underlying bundle in response to continuous downward movement of the bag stretching structure once the closed end of the bag opposite the open end thereof has engaged the top surface of the bundle.

24 Claims, 5 Drawing Sheets

APPARATUS FOR BAGGING MATERIAL

RELATED APPLICATIONS

The present application claims priority on Canadian Patent Application No. 2,340,838 filed on Mar. 15, 2001 and on U.S. Provisional Patent Application No. 60/305,162 filed Jul. 16, 2001.

BACKGROUND OF THE INVENTION

1. Field of the Invention

The present invention relates to an apparatus and a method for bagging goods, such as bundles of wood, in stretchable bags.

2. Description of the Prior Art

Some wood products, such as rectangular bundles of lumber strips, need to be protected from the environment and stored in a way such as to preserve an appropriate degree of humidity and prevent UV rays from damaging the wood.

In the past, various bagging apparatus have been developed to load agricultural products into stretchable plastic tube. However, there is still a need for a new apparatus and method for providing effective and convenient bagging or sheathing of rigid wood products into stretchable bags or the like.

SUMMARY OF THE INVENTION

It is therefore an aim of the present invention to provide an apparatus and a method for wrapping material, such as bundles, into stretchable bags.

It is also an aim of the present invention to provide such an apparatus which is of sturdy construction.

It is a further aim of the present invention to provide such an apparatus which is reliable and which offers convenience in use.

Therefore, in accordance with the present invention, there is provided an apparatus for bagging material into a stretchable bag having an open end. The apparatus comprises a movable bag stretching structure displaceable between a first position for receiving the bag and a second position for holding the bag in a stretched state. The apparatus further includes at least two bag gripping members for turning the bag inside out over the movable bag stretching structure while the same is in its first position. An actuator is provided for displacing the bag stretching structure towards a facing side of the material while the bag is held in a stretched state thereon such that a continuous movement of the bag stretching structure about the material causes the bag to be gradually inverted on the material after the bag has engaged the facing side of the material.

In accordance with a further general aspect of the present invention, there is provided a method for wrapping a bundle into a stretchable bag having an open end and an opposed closed end, comprising the steps of: fitting the bag about a stretching structure, stretching the bag by operation of said stretching structure, and wrapping the bundle into the taut bag by inverting the bag onto the bundle.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
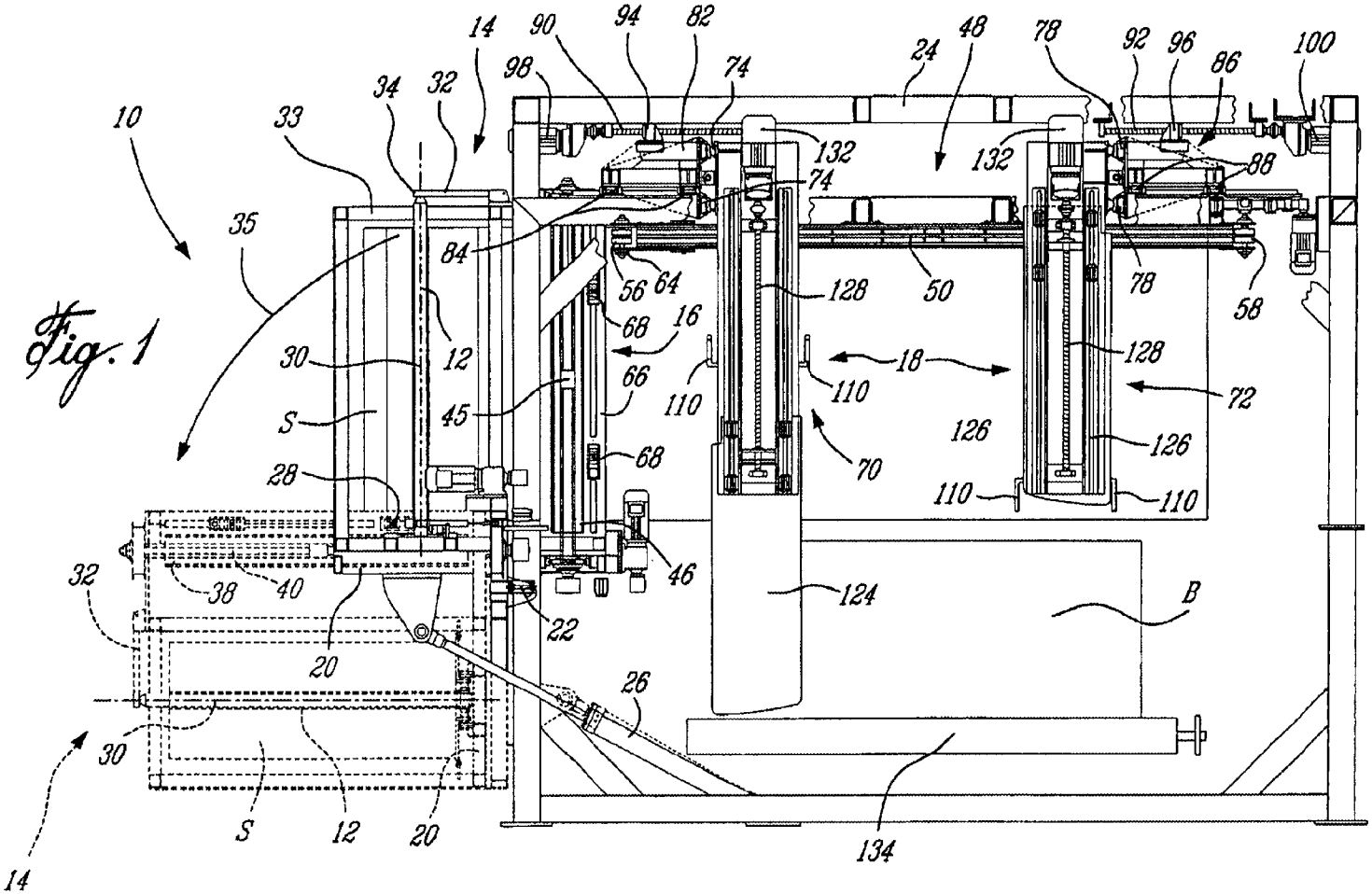
FIG. 1 is a side elevation view of a bagging apparatus in accordance with a preferred embodiment of the present invention.

Now referring to the drawings, and in particular to FIG. 1, a bagging apparatus 10 suited for sheathing or bagging a substantially rectangular or square bundle B of wood within a resilient sheath S will be described.

The sheath S is provided in the form of an elongated web of flexible, stretchable, resilient plastic material that is folded in two about a central longitudinal axis thereof and then rolled on a supply reel 12 with the fold line of the sheath S forming the upper edge of the roll of material.

The bagging apparatus 10 generally comprises a supply unit 14, a sealing and cutting unit 16 and a stretching and bagging unit 18.

The supply unit 14 comprises a loading platform 20 pivotally mounted at 22 to a rectangular framework 24 supporting the sealing and cutting unit 16 and the stretching and bagging unit 18 of the apparatus 10. A hydraulic cylinder 26 extends between the framework 24 and the loading platform 20 to pivot the latter between a horizontal functional position and a vertical loading position (both positions being shown in solid lines in FIG. 1). A motorized turntable 28 is mounted on the platform 20. An axle 30 extends at right angles from the turntable 28 for receiving the supply reel 12. A pivot arm 32 is pivotally mounted to a frame structure 33 mounted to the platform 20 for receiving the free distal end of the axle 30 once the supply reel 12 has been loaded thereon. A lock pin 34 is provided to lock the pivot arm 32 to the axle 30, thereby preventing axial withdrawal of the reel 12 from the axle 30.

To load a new supply reel on the axle 30, the platform 20 is first pivoted from its horizontal position to the vertical position thereof, as indicated by arrow 35 in FIG. 1; second, the lock pin 34 is removed and the pivot arm 32 is manually pivoted away from the axle 30; and finally, the reel 12 is slidably fitted on the axle 30. Thereafter, the pivot arm 32 is pivoted back in engagement with the axle 30 and locked thereto, and the cylinder 26 is extended to pivot the platform 20 back to its horizontal position. A brake 36 (FIG. 2) is provided for engaging the turntable 28 to prevent the sheath S from being unrolled from the supply reel 12 when required or desired.

Figure 2:
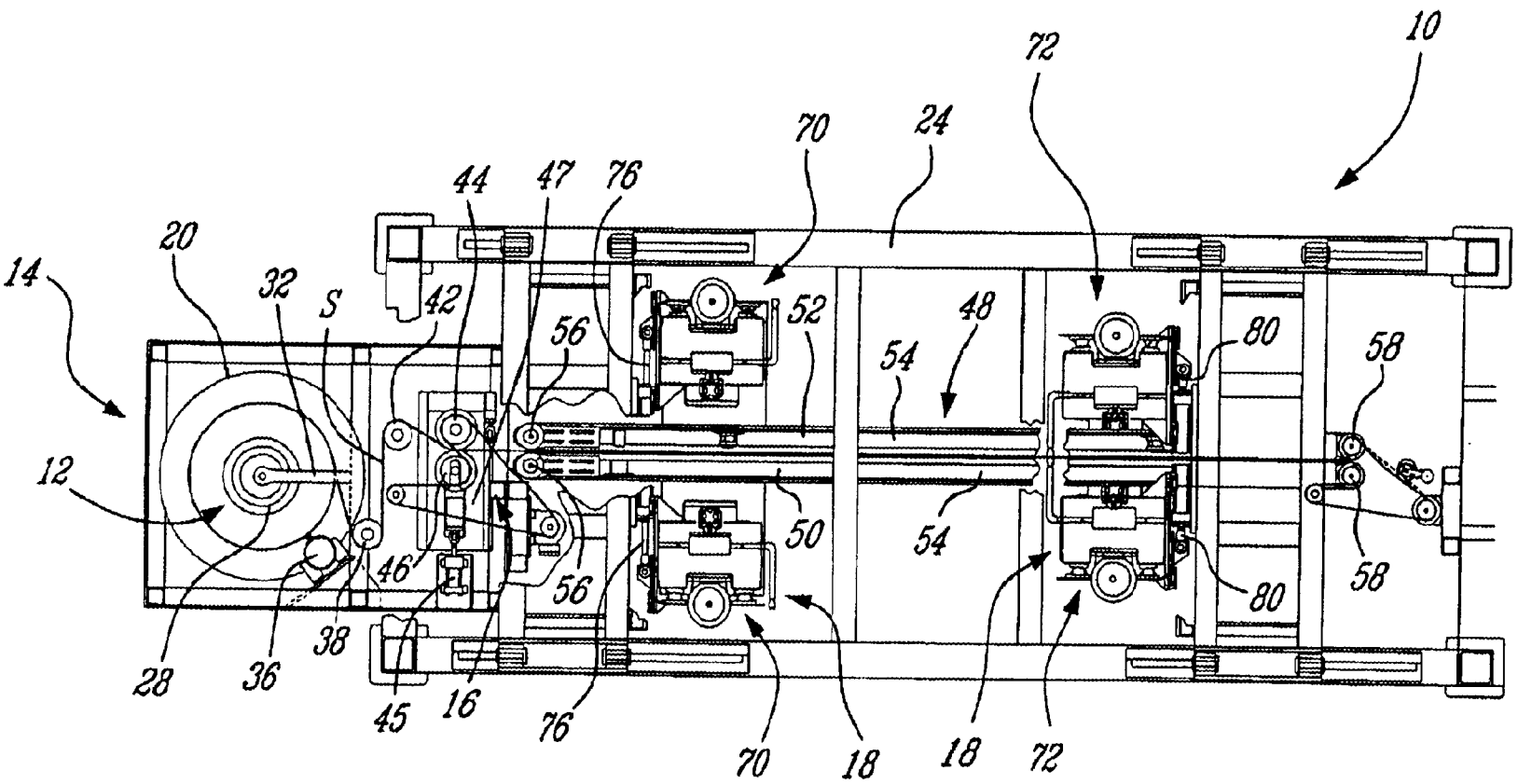
FIG. 2 is a top plan view of the bagging apparatus of FIG. 1.

As shown in FIGS. 1 and 2, the sheath S is directed from the supply reel 12 to a first pre-stretching motorized roller 38 mounted on a vertical shaft 40 which is, in turn, mounted on the loading platform 20. A second pre-stretching motorized roller 42 (FIG. 2) is provided on the framework 24 for receiving the sheath S from the first pre-stretching roller 38. The first and second pre-stretching rollers 38 and 42 cooperate to pre-stretch the sheath S so as to subsequently facilitate the full stretching thereof in the stretching and bagging unit 18. Two or more set of pre-stretching rollers driven at increased speed from one set to the next can be provided for pre-stretching the sheath S before the same is transferred to the stretching and bagging unit 18.

From the second pre-stretching roller 42, the sheath S is directed between a pair of indexing motorized vertical rollers 44 and 46 supported by the framework 24. As seen in FIG. 2, the roller 46 is mounted to a support 47. A pneumatic cylinder 45 is provided for linearly reciprocating the support 47 and, thus, the roller 46 away from and towards the roller 44. In use, the roller 46 is initially displaced away from the roller 44 to an open position for receiving the sheath S and then displaced back against the sheath S and the roller 44 to a closed functional position for drawing the sheath S forward into the apparatus 10.

Figure 3:
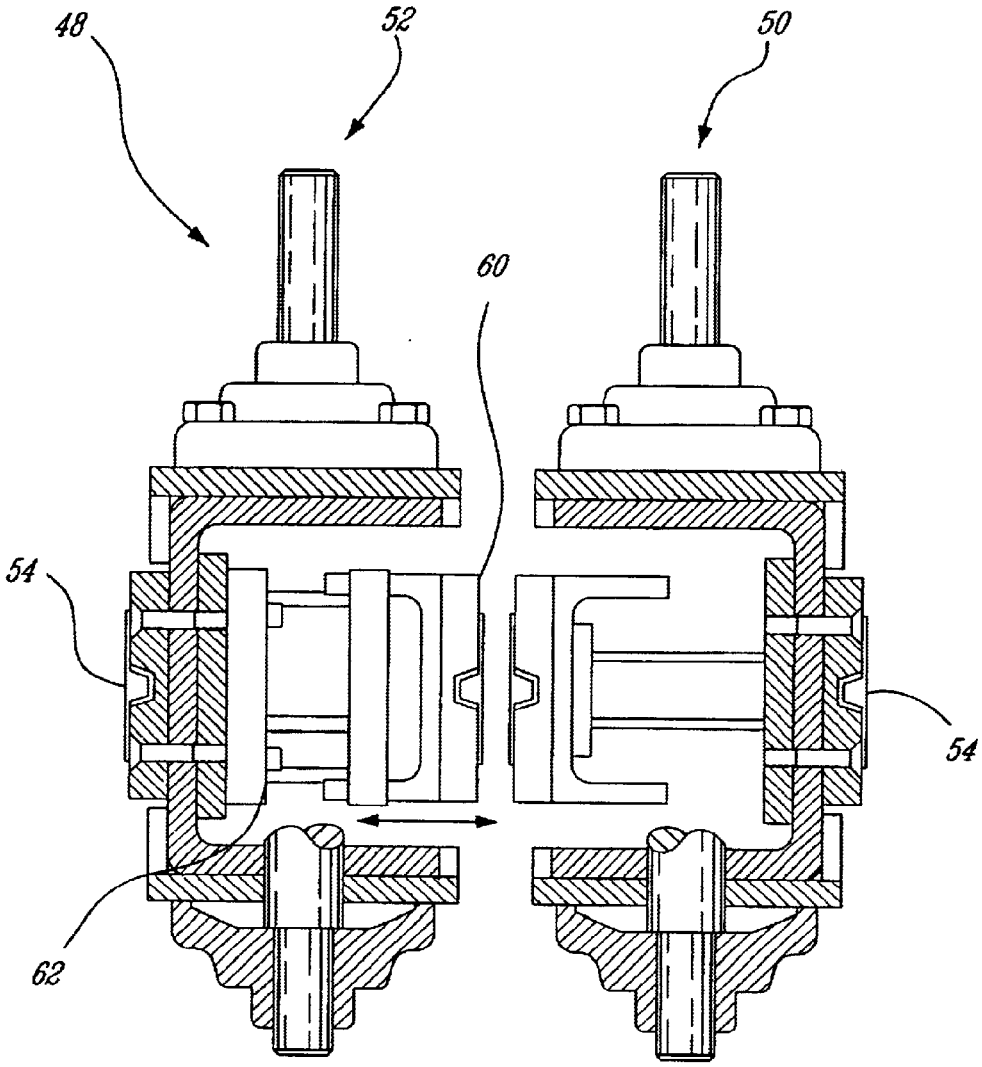
FIG. 3 is a cross-sectional view of a pair of side-by-side belt conveyors forming part of the apparatus of FIG. 1.

The sheath S is transferred from the indexing rollers 44 and 46 to an overhead transport rail system 48 mounted to the framework 24. As seen in FIG. 2, the overhead transport rail system 48 includes a pair of side-by-side axially extending belt conveyors 50 and 52 adapted to receive therebetween the upper end of the sheath S (i.e. the end with the fold line). The belt conveyors 50 and 52 each include an endless flexible belt 54 extending over a pair of axially spaced-apart rollers 56 and 58. The roller 58 of each pair is motorized to drive the associated belt 54. The belt 54 of the conveyor 52 slides between rollers 56 and 58 on a movable plate 60 (FIG. 3) displaceable towards, and away from, the other belt conveyor 50 so as to close or open the gap defined between the conveyors 50 and 52. A pair of pneumatic cylinders 62 (FIG. 3) are provided for displacing the plate 60. When the overhead transport system 48 is used to transport the sheath S forwardly through the apparatus 10, the cylinders 62 are extended and when it is desired to release the sheath S, the cylinders 62 are retracted so as to increase the gap between the belts 54 of the conveyors 50 and 52.

As seen in FIG. 1, the rollers 56 and 58 of the conveyors 50 and 52 are mounted on respective shafts 64. The position of the rollers 56 and 58 is adjustable along the shafts 64 for allowing the apparatus 10 to be used in conjunction with sheaths of different sizes.

As shown in FIGS. 1 and 2, the sealing and cutting unit 16 is mounted to the framework 24 between the indexing rollers 44 and the overhead transport rail system 48. The sealing and cutting unit 16 generally comprises a vertically displaceable cutting blade (not shown) and a pair of vertically extending elongated heating elements 66 facing each other from opposite sides of the central axis of the apparatus 10. The heating elements 66 are positioned to receive the sheath S therebetween and are displaceable towards, and away from, each other between a closed operative position and an open idle position. Pneumatic cylinders, such as those illustrated at 68 in FIG. 1, are provided for displacing the heating elements 66 between the open and closed positions thereof. Each heating element can be provided with a pair of heating bands (not shown) to simultaneously seal the sheath S on each side of the cut. It is also understood that a linear actuator (not shown) is provided for displacing the cutting blade in upward and downward directions to effect cutting of a desired length of sheath S.

Referring to FIGS. 1 and 2, it can be seen that the stretching/bagging unit 18 comprises an upstream pair of stretching columns 70 and an identical pair of downstream stretching columns 72. The upstream stretching columns 70 are slidably mounted in linear front transversal rails 74 (FIG. 1) and are displaceable towards, and away from, each other by means of a pair of cylinders 76 (FIG. 2) mounted in an end-to-end relationship between the upstream stretching columns 70. Likewise, the downstream stretching columns 72 are slidably mounted in linear transversal rails 78 and are displaceable towards, and away from, each other by means of a pair of cylinders 80 mounted in an end-to-end relationship between the downstream stretching columns 72. The transversal rails 74 form part of a front carriage 82 mounted in linear axially extending rails 84 provided on top of the framework 24. Similarly, the transversal rails 78 form part of a rear carriage 86 mounted in linear axially extending rails 88 provided on top of the framework 24. First and second ball screws 90 and 92 are respectively engaged with first and second ball nuts 94 and 96 for respectively displacing the front and rear carriages 82 and 86 along the longitudinal axis of the apparatus 10, as illustrated in FIG. 1. The first and second ball screws 90 and 92 are driven by respective electric rotary motors 98 and 100. Accordingly, the ball screws 90 and 92 are operable to displace the pair of upstream stretching columns 70 and the pair of downstream stretching columns 72 towards, and away from, each other along the longitudinal axis of the apparatus 10.

Figures 4, 5, 6:
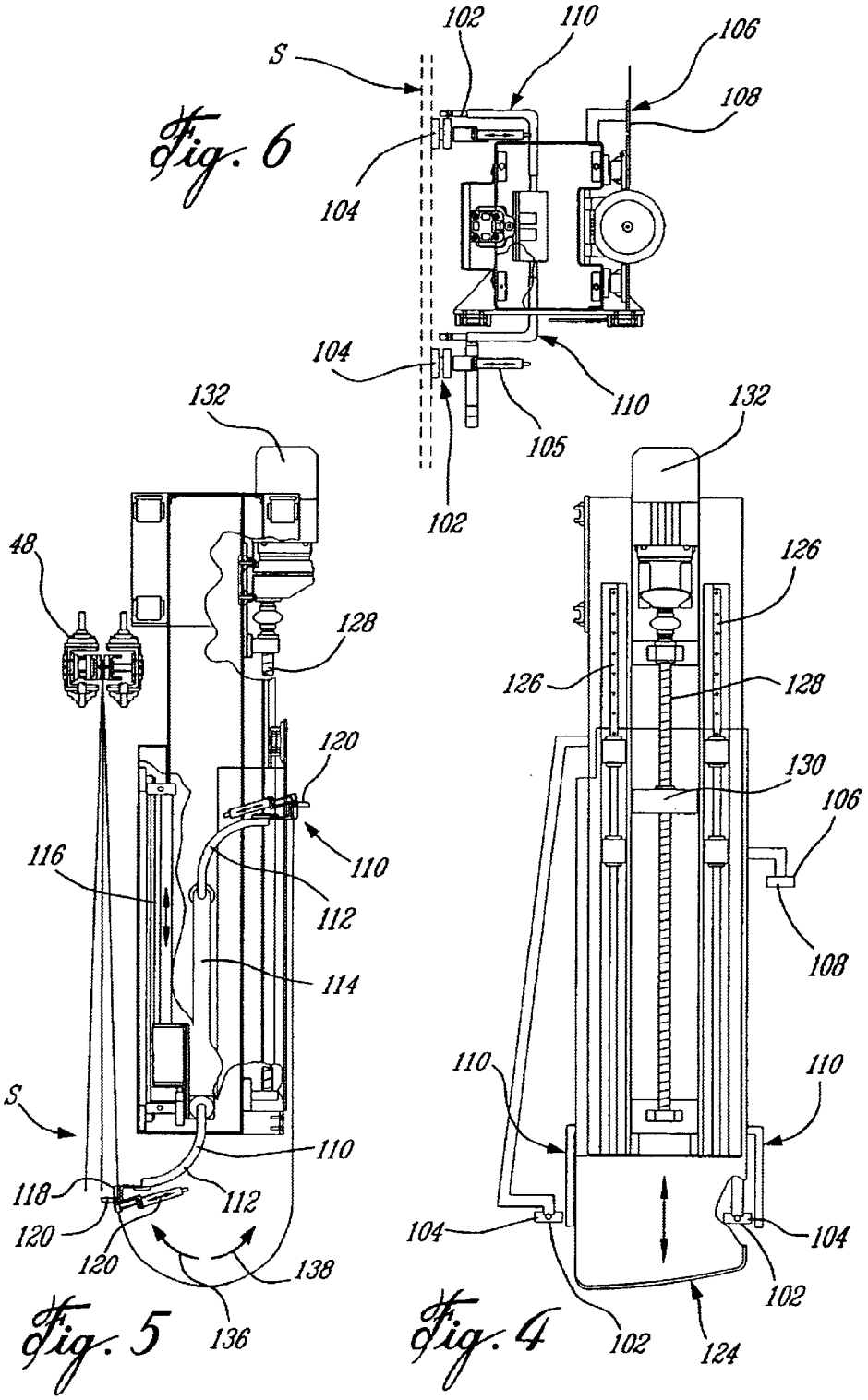
FIG. 4 is a schematic side elevation view of a stretching column forming part of a stretching and bagging unit of the apparatus of FIG. 1.
FIG. 5 is a schematic front elevation view of the stretching column of FIG. 4.
FIG. 6 is a schematic top plan view of the stretching column of FIG. 4.

As seen in FIGS. 4, 5 and 6, each column 70/72 comprises on opposed sides thereof a pair of lower suction members 102 for opening the sheath S after the same has been cut and sealed so as to form a bag open at its bottom (FIG. 5). Each lower suction member 102 includes a hollow perforated planar head 104 which is connected to a pneumatic cylinder 105 (FIG. 6) for allowing the same to be linearly displaced relative to the associated column 70/72 towards and away from the sheath S. A vacuum pump (not shown) or the like is provided for drawing air into the suction members 102 through the perforated heads 104 thereof. Each column 70/72 is further provided with an upper suction member 106 having a perforated face plate 108 through which air can be drawn by operation of the vacuum pump. As opposed to the perforated heads 104 of the lower suction members 102, which are located on the inner side of the columns 7Q and 72, the perforated face plates 108 of the upper suction members 106 are located on the outer side of the columns 70 and 72 so as to retain the bag when the same has been turned inside out over the columns 70 and 72, as will explained hereinbelow.

Each stretching column 70/72 is further provided on opposed lateral sides thereof with a pair of rotary gripping arms 110. As seen in FIG. 5, each rotary gripping arm 110 includes an arcuate arm segment 112 which is 180 degrees pivotable relative to the associated column 70/72 for allowing the bag to be turned inside out over the columns 70 and 72. Each rotary gripping arm 110 is linearly displaceable in a vertical slot 114 defined in the associated column 70/72. An actuator 116, such as a rodless TOL-O-MATIC actuator, can be provided within each column 70/72 for linearly displacing the associated pair of rotary gripping arms 110.

Each rotary gripping arm 110 is provided with a stationary gripping finger 118 and a pivotable gripping finger 120. A pneumatic cylinder 122 is provided for displacing the pivotable gripping finger 120 between an open position and a closed position wherein the pivotable gripping finger 120 is urged against the associated stationary finger 118 to clamp a side of the bag at the mouth thereof.

Finally, as shown in FIG. 4, each column 70/72 is provided with a vertically movable sheath lowering plate 124. The sheath lowering plate 124 is mounted in a pair of vertical rails 126 provided on an outer side of the associated column 70/72. The sheath lowering plate 124 is displaced along the rails 126 in opposed ascending and descending directions by means of a ball screw 128 engaged with a ball nut 130 secured to the sheath lowering plate 124. An electric motor 132 is provided for driving the ball screw 128 and, thus, cause displacement of the plate 124.

Figure 8:
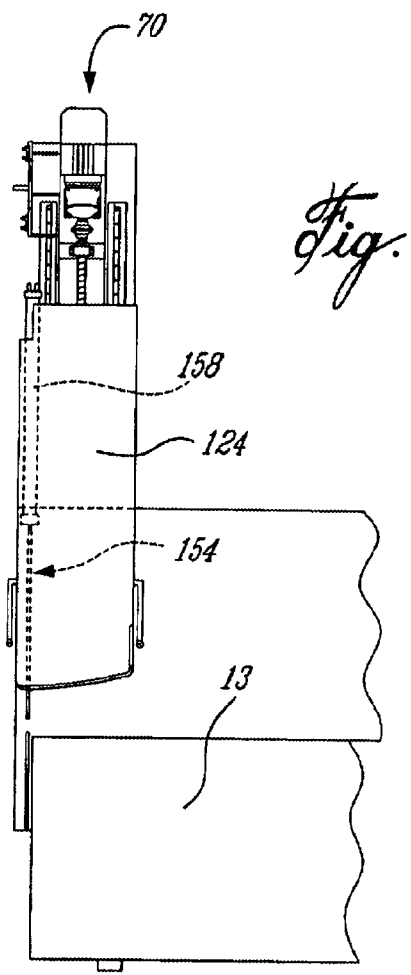
FIG. 8 is a simplified side elevation view of one of the stretching column and associated folding system of FIG. 7.

It is also contemplated to equip one of the front columns 70 and one of the rear columns 72 with a tip folding system 150 (FIGS. 7 and 8) to fold down or press down the triangular tip 152 formed by the seams at the upstream and downstream ends of the sheath or bag. As exemplified in connection with the columns 70, each tip folding system 150 is operational to place the tip 152 of the associated seam of the bag against the corresponding face of the bundle B to be bagged so that when the bag is inverted onto the bundle B, the tip 152 of the seam is folded into the outer surface of the bag itself, as opposed of extending upwardly from one end of the bundle B.

Figure 7:
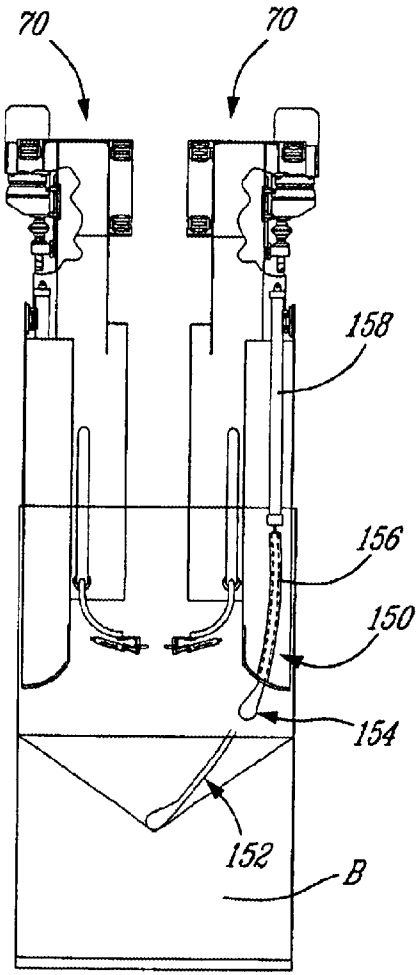
FIG. 7 is a simplified front end elevation view of a pair of stretching column, one of which is equipped with a tip folding system in accordance with one aspect of the present invention.

Each tip folding system 150 generally includes an arcuate arm 154 slidable between an extended position (shown in broken lines in FIG. 7) and a retracted position within a guiding structure 156 provided on an inner facing side of the associated column 70/72. The arm 154 is displaced by operation of a pneumatic cylinder 158 mounted within the column 70/72. According to one embodiment of the present invention, the pneumatic cylinder 158 has a 36 inches stroke. By extending the pneumatic cylinder 158 while the bag is stretched and turned inside out over the columns 70 and 72, the arm 154 is lowered so as to place and maintain the tip 152 of the seam against the associated end face of the bundle B, as illustrated in FIG. 7. The subsequent lowering of the vertically movable sheath lowering plate 124 will cause the bag to be inverted onto the bundle B with the tip 152 covered by or folded into the exterior surface of the bag so as to form a pleat in the bag at each end of the bagged bundle. After the folding operation, the pleat formed by the tip 152 can be sealed or otherwise secured in place to prevent the same from being unfolded while the bagged bundle is transported from one location to another.

As seen in FIG. 1, the bundle B is supported in position within the framework 24 underneath the overhead transport system 48 by a roller conveyor 134. It is understood that an entry conveyor (not shown) and an exit conveyor (not shown) are also provided at opposed ends of the apparatus 10.

In operation, a length of sheath S is drawn into the apparatus 10 from the supply reel 12 between the indexing rollers 44 and the overhead transport rail system 48 above the bundle B so as to determine the length of sheath S to be cut in accordance with the bundle length. Then, the sheath S is cut and sealed to form the closed downstream end of a bag for the underlying bundle B and a closed upstream end for the next bundle to be bagged. It is understood that the upstream end of the sheath S has been previously sealed during a previous bagging cycle. After, the sheath S has been cut and sealed, the overhead transport rail system 48 is powered back to displace the so-formed bottom open bag directly above the underlying bundle B.

Then, the cylinders 76 and 80 are operated to displace the columns 70 and 72 towards the sides of the bag and the mouth thereof is opened by extending the lower suction members 102 next to the opposed external sides of the bag and by subsequently operating the vacuum pump to cause the bottom end of the bag to be drawn against the perforated heads 104 of the lower suction members 102, as illustrated in FIG. 5. Once the mouth of the bag has been opened by the bottom suction members 102, the rotary gripping arms 110 are pivoted, as indicated by arrow 136 in FIG. 5, and the gripping fingers 118 and 120 thereof become closed against the sides of the bag. The suction at the perforated heads 104 of the lower suction members 102 is then stopped and the overhead transport rail system 48 is displaced to an open position thereof in order to release the upper end of the bag.

Thereafter, the bag is turned inside out over the four columns 70 and 72 by imparting a rotation of 180 degrees to the rotary gripping arms 110 in the direction indicated by arrow 138 in FIG. 5. The bag is then fitted about the columns 70 and 72 by linearly displacing the rotary gripping arms 110 to the upper end of the associated slot 114, as shown in FIG. 5. Air is then drawn into the upper suction members 106 to retain the bag and the gripping fingers 118 and 120 of all the gripping arms 110 are opened to release the bag therefrom. The open mouth of the bag is then at the upper end thereof.

Once the bag has been properly inverted and fitted about the columns 70 and 72, the cylinders 76 and 80 are actuated to stretch the bag in the transversal direction of the bundle B and the framework 24. Then, the ball screws 90 and 92 are operated to stretch the bag in the longitudinal direction of the bundle B. At this point, the vacuum pump can be shut down. The cylinders 158 are then extended to lower the arms 150 to position the tips 152 of the seams at the downstream and upstream ends of the bag against the corresponding faces of the bundle B, as illustrated in FIG. 7. The taut open end bag is then lowered onto the underlying bundle by actuating the ball screws 128 so as to downwardly displace the sheath lowering plates 124 and cause the bag to be inverted on the bundle B as the top surface of the bundle B engages the bottom closed end of the bag opposite the open end thereof. Once, the bag has been fitted on the bundle B with the tips 152 of the seams folded inwards, the arms 154 are retracted and the plates 124 are displaced upwardly. The stretching columns 70 and 72 are then returned to their initial positions. Thereafter, the bagged bundle is displaced to a storage location and another bundle may be bagged as per the cycle described hereinabove.

What is claimed is:

1. An apparatus for bagging material into a stretchable bag having an open end, comprising a movable bag stretching structure having at least two stretching members displaceable between a first position for receiving the bag and a second position for holding the bag in a stretched state, at least two bag gripping members for releasably gripping the bag at said open end thereof, each of said bag gripping members being mounted on an associated one of the at least two stretching members and pivotable outwardly to turn the bag inside out over said movable bag stretching structure while the bag stretching structure is in said first position thereof, and an actuator for displacing said bag stretching structure towards a bag facing side of the material while the bag is held in a stretched state thereon such that a continuous movement of the bag stretching structure about the material causes the bag to be gradually inverted on the material as the bag engages the bag facing side thereof.

2. An apparatus as defined in claim 1, wherein said bag is made of a stretchable bagging material, and wherein said apparatus further includes a pre-stretching unit for stretching said bagging material before transferring the same to said movable bag stretching structure.

3. An apparatus as defined in claim 2, wherein said pre-stretching unit includes at least first and second rollers over which the stretchable bagging material is pre-stretched.

4. An apparatus as defined in claim 3, wherein said first and second rollers are motorized.

5. An apparatus as defined in claim 1, further comprising a supply unit including a reel adapted to receive a roll of bagging material.

6. An apparatus as defined in claim 5, wherein said reel is mounted on a turntable.

7. An apparatus as defined in claim 6, wherein said turntable is mounted on a loading platform pivotable between a vertical loading position and a horizontal bagging material-dispensing position.

8. An apparatus as defined in claim 6, wherein said turntable is motorized, and wherein a brake is provided for selectively engaging the turntable.

9. An apparatus as defined in claim 5, further comprising a pair of motorized indexing rollers between the supply unit and the bag stretching structure, said motorized indexing rollers being movable towards and away from each other between an open position for receiving the bagging material therebetween and a closed position for drawing the bagging material forward into the bag stretching structure.

10. An apparatus as defined in claim 5, further comprising an overhead transport rail system for carrying the bag over the material to be sheathed, said overhead transport rail system including a pair of side-by-side axially extending belt-like conveyors adapted to receive therebetween a closed upper end of the bag, said conveyors being displaceable towards and away from each other so as to adjust a gap defined between the conveyors.

11. An apparatus as defined in claim 10, wherein one of said belt-like conveyors includes an endless belt extending over a plate movable towards and away from an other one of said belt-like conveyors.

12. An apparatus as defined in claim 1, further including a vacuum system adapted to open the bag in order to facilitate subsequent grasping of opposite sides thereof by said at least two bag gripping members.

13. An apparatus as defined in claim 12, wherein said bag stretching structure includes a first pair of bag stretching columns and a second pair of bag stretching columns located on a downstream side of said first pair of columns, said columns of said first pair being located on opposed sides of a central longitudinal axis of the apparatus, said columns of said second pair being also located on opposed sides of said central longitudinal axis.

14. An apparatus as defined in claim 13, wherein said at least two bag gripping members include four bag gripping members, each bag gripping member being pivotally mounted to an associated one of said bag stretching columns for allowing the bag to be turned inside out over the columns.

15. An apparatus as defined in claim 14, wherein each bag gripping member is axially movable relative to said associated one of said columns for fitting the bag inside out about the columns.

16. An apparatus as defined in claim 15, wherein said vacuum source, includes a suction head at an upper end portion of each of said columns to releasably retain the bag about the columns once the bag has been fitted thereover by operation of said bag gripping members.

17. An apparatus as defined in claim 15, wherein each bag stretching column further includes a sheath lowering plate axially movable to cause the bag fitted about, the columns to be inverted onto the material to be bagged.

18. An apparatus as defined in claim 13, wherein said first and second pairs of columns are respectively mounted on first and second carriages displaceable along said longitudinal axis of the apparatus.

19. An apparatus as defined in claim 18, wherein said columns of: said first pair of columns are movable towards and away from each other along an axis perpendicular to said longitudinal axis of the apparatus, and wherein said columns of said second pair of columns are also movable towards and away from each other.

20. An apparatus as defined in claim 13, wherein, for a bag having a closed end defining opposed triangular corners, at least one of the columns of the first pair of columns and at least one of the columns of the second pair of columns are each provided with a tip folding system adapted to fold down the triangular corners of the bag into an outer pleat of the bag while the bag is being inverted onto the material to be bagged.

21. An apparatus as defined in claim 20, wherein each said tip folding system includes an arcuate arm slidable between an extended position and a retracted position within a guiding structure provided on an inner facing side of an associated one of the columns.

22. An apparatus as defined in claim 1, wherein said bag stretching structure includes a first pair of bag stretching columns and a second pair of bag stretching columns located on a downstream side of said first pair of columns, said columns of said first pair being located on opposed sides of a central longitudinal axis of the apparatus, said columns of said second pair being also located on opposed sides of said central longitudinal axis.

23. An apparatus for bagging material into a stretchable bag having an open end, comprising a movable bag stretching structure displaceable between a first position for receiving the bag and a second position for holding the bag in a stretched state, at least two bag gripping members for turning the bag inside out over said movable bag stretching structure while the bag stretching structure is in said first position thereof, and an actuator for displacing said bag stretching structure towards a facing side of the material while the bag is held in a stretched state thereon such that a continuous movement of the bag stretching structure about the material causes the bag to be gradually inverted on the material as the bag engages the facing side thereof, wherein said bag stretching structure includes a first pair of bag stretching columns and a second pair of bag stretching columns located on a downstream side of said first pair of columns, said columns of said first pair being located on opposed sides of a central longitudinal axis of the apparatus, said columns of said second pair being also located on opposed sides of said central longitudinal axis, and wherein said at least two bag gripping members include four bag gripping members, each bag gripping member being pivotally mounted to an associated one of said bag stretching columns for allowing the bag to be turned inside out over the columns.

24. An apparatus as defined in claim 23, wherein each bag gripping member is axially movable relative to said associated one of said columns for fitting the bag inside out about the columns.

* * * * *